United States Patent [19]

Mey

[11] Patent Number: 4,513,071

[45] Date of Patent: Apr. 23, 1985

[54] ERASABLE INFORMATION RECORDING PROCESS USING CO-CRYSTALLINE DYE COMPLEXES

[75] Inventor: William Mey, Rochester, N.Y.

[73] Assignee: Eastman Kodak Company, Rochester, N.Y.

[21] Appl. No.: 553,912

[22] Filed: Nov. 21, 1983

[51] Int. Cl.[3] ..... G03C 1/72; G03C 7/00; G03G 5/026; G03G 13/16

[52] U.S. Cl. ..... 430/19; 430/31; 430/46; 430/56; 430/70; 430/75; 430/76; 430/96; 430/126; 430/332; 430/338

[58] Field of Search ..... 430/19, 332, 338, 70, 430/75, 76, 31, 56, 96, 46, 126; 427/43.1, 53.1, 56.1, 283

[56] References Cited

U.S. PATENT DOCUMENTS

| | | | |
|---|---|---|---|
| 3,122,438 | 2/1964 | Chalkley | 430/338 |
| 3,166,433 | 1/1965 | Baumann et al. | 430/338 |
| 3,615,414 | 10/1971 | Light | 430/75 |
| 3,769,011 | 10/1973 | Gilman et al. | 430/83 |
| 4,175,960 | 11/1979 | Berwick et al. | 430/76 |

*Primary Examiner*—Richard L. Schilling
*Attorney, Agent, or Firm*—Bernard D. Wiese

[57] ABSTRACT

A process for recording an erasable pattern which comprises selective deaggregation of an aggregate dye complex layer of a recording element. As a result, a color change occurs in the selected areas. In preferred embodiments, the pattern is produced by selectively exposing the layer to laser light. The pattern can be erased by exposing the layer to an appropriate solvent, or by heating the aggregate dye complex.

11 Claims, No Drawings

ERASABLE INFORMATION RECORDING PROCESS USING CO-CRYSTALLINE DYE COMPLEXES

BACKGROUND OF THE INVENTION

1. Field of the Invention

The present invention relates to optical information recording. In particular it relates to a process for forming an erasable image.

2. Description of the Prior Art

It is known to use energy to record an image by effecting a change in a material. For example, the heat generated by a laser beam can be used to change the properties of many materials to make a visible record. For example, U.S. Pat. No. 3,723,121, describes laser beam recording in a thermochromic material which, in its unexposed state, absorbs, but in its exposed state, transmits the beam. No method of erasing the image is mentioned.

As another example, U.S. Pat. No. 3,636,526 proposes the use of certain amorphous semiconductive materials, such as a selenium alloy or a calcogenide, as typified by $Ge_{15}Te_{81}Sb_2S_2$, $As_2S_3$ and $As_{20}Se_{60}Ge_{20}$. When a laser beam is applied to a thin film of such material, voids are formed in the material which provide a visible pattern. It is possible to erase the recorded pattern by heating the material.

U.S. Pat. No. 3,971,874 proposes a recording material having a thin film of a vacuum-deposited tellurium oxide, $TeO_x$, where x is smaller than 2.0. When irradiated with a laser beam, the thin film of the suboxide undergoes a change from a low optical density state to a high optical density state. However, it is reportedly difficult to erase information recorded on this material.

As another example, U.S. Pat. No. 4,278,734 describes an optical information recording material comprising a thin film of a suboxide of a metal or semimetal of Group IIIB, IVB, VB, or VIB, e.g., $TeO_x$ where $x<2.0$ or $BiO_x$ where $x<1.5$, added with up to 50 mole % of S and/or Se. When irradiated with light of relatively low energy density, the thin film exhibits such changes in optical density that information can be optically recorded on it with high contrast ratio. Recorded information can be reproduced by either transmitted light or reflected light and, when desired, can be erased by light irradiation of adequate energy density.

None of these references suggest the method of recording with materials used in accordance with the present invention. Furthermore, the previous materials have one or more drawbacks as recording materials such as low optical sensitivity, low image contrast, difficulty of erasure, expense of manufacture or the inclusion of components which are toxic or costly.

SUMMARY OF THE INVENTION

The present invention provides a novel optical information recording process. In accordance with the present invention, information is recorded on a film or other element containing an aggregate dye complex layer by selective deaggregation. The recording material is an aggregate composition comprising a spectral sensitizing dye and a film forming polymer, or alternatively an aggregation of sensitizing dyes.

The aggregate dye complex reverts to a homogeneous state in the selected areas that have been exposed to a deaggregating force. The result is a color change in the exposed areas.

A preferred method of deaggregation is to expose the aggregate dye complex to actinic radiation, such as a laser beam. The recorded optical information can then be erased by softening the composition sufficiently so that reaggregation occurs. One method of erasure comprises exposing the material to an organic solvent. Appropriate solvents are substituted hydrocarbon solvents, with preferred solvents being halogenated hydrocarbon solvents. Erasure can also be effected by heating the composition sufficiently to soften it, but not to the extent that deaggregation will occur. The temperature and duration of heating required will vary depending on the composition of the aggregate dye complex.

When the aggregate dye complex is formed in a photoconductive element, deaggregation changes not only the color but also the photoconductive sensitivity of the composition; that is, the composition exhibits differential photoconductivity between the aggregated and deaggregated areas. An aggregate photoconductive element on which a pattern has been recorded by the method of the invention can then be used as a printing plate or duplicating master.

DETAILED DESCRIPTION OF THE PREFERRED EMBODIMENTS

Aggregate dye complex compositions useful in the method of the invention are multiphase organic solids containing dye-dye or dye-polymer complexes. The polymer forms an amorphous matrix or continuous phase which contains a discrete discontinuous phase as distinguished from a solution. The discontinuous phase is an aggregate species which is a co-crystalline complex comprised of dye and polymer. Alternatively, the co-crystalline complex may consist essentially of dyes. The term "co-crystalline complex" is used herein as reference to a complex which contains dye and polymer molecules or dye-dye molecules co-crystallized.

Aggregate dye complex compositions useful in the method of the invention, especially as employed in photoconductive elements, have been described in a number of U.S. patents, e.g. U.S. Pat. No. 3,615,396; 3,615,414; 3,615,415; 3,679,406; 3,679,407; 3,679,408; 3,684,502; 3,706,554; 3,873,311; 4,175,960; 4,301,226; 4,350,751; and also in Perlstein et al U.S. Application Ser. No. 435,524, filed Oct. 20, 1982; Canadian Pat. No. 1,129,426; and in Borsenberger et al, *J. Appl. Physics* 49 (11), November 1978 pp 5543–54.

Another characteristic of the aggregate dye complex compositions described in the above-mentioned U.S. patents is that the wavelength of the radiation absorption maximum (also known as $\nu$max) characteristic of such compositions is shifted by at least about 10 nm from the wavelength of $\nu$max of a substantially homogeneous dye or dye/polymer solid solution formed of similar constituents. This shift in the wavelength of $\nu$max is the key to the formation of the visible image. When the aggregate dye complex is selectively deaggregated, it reverts to a homogeneous state in the selected areas, producing a color shift which results in an optical record.

Materials suitable for the practice of the invention include, but are not limited to, those described below.

Particularly useful aggregating dyes are pyrylium dyes, including pyrylium, thiapyrylium, selenapyrylium, telluropyrylium dye salts. They can be represented by the following general formula:

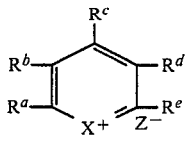

wherein $R^a$, $R^b$, $R^c$, $R^d$, and $R^e$ can each represent (a) a hydrogen atom; (b) an alkyl group, preferably having from 1 to 15 carbon atoms, such as methyl, ethyl, propyl, isopropyl, butyl, tertiary butyl, amyl, isoamyl, hexyl, octyl, nonyl, and dodecyl, (c) alkoxy groups such as methoxy, ethoxy, propoxy, butoxy, amyloxy, hexoxy, octoxy; and (d) aryl groups including substituted aryl groups such as phenyl, 4-diphenyl, alkylphenyls as 4-ethylphenyl, 4-propylphenyl, and alkoxyphenyls as 4-ethoxyphenyl, 4-methoxyphenyl, 4-amyloxyphenyl, 2-hexoxyphenyl, 2-methoxyphenyl, 3,4-dimethoxyphenyl, and β-hydroxy alkoxyphenyls as 2-hydroxyethoxyphenyl, 3-hydroxyethoxyphenyl, and 4-hydroxyphenyl, halophenyls as 2,4-dichlorophenyl, 3,4-dibromophenyl, 4-chlorophenyl, 3,4-dichlorophenyl, and azidophenyl, nitrophenyl, aminophenyls such as 4-diethylaminophenyl, 4-dimethylaminophenyl and naphthyl; and vinyl substituted aryl groups such as styryl, methoxystyryl, diethoxystyryl, dimethylaminostyryl, 1-butyl-4-p-dimethylaminophenyl-1,3-butadienyl, β-ethyl-4-dimethylaminostyryl; and where X is a sulfur, oxygen, tellurium or selenium atom, and $Z^-$ is an anion, including such anions as perchlorate, fluoroborate, iodide, chloride, bromide, sulfate, periodate, p-toluenesulfonate, and hexaflurophosphate. In addition, the pair $R^a$ and $R^b$ as well as the pair $R^d$ and $R^e$ can together be the necessary atoms to complete an aryl ring fused to the pyrylium nucleus.

Examples of pyrylium dyes for use in the aggregate dye complex are listed in Table 1.

TABLE 1

| Compound Number | Name of Compound |
|---|---|
| 1 | 4-[4-bis(2-chloroethyl)aminophenyl]-2,6-diphenylthiapyrylium perchlorate |
| 2 | 4-(4-dimethylaminophenyl)-2,6-diphenylthiapyrylium perchlorate |
| 3 | 4-(4-dimethylaminophenyl)-2,6-diphenylthiapyrylium fluoroborate |
| 4 | 4-(4-dimethylamino-2-methylphenyl)-2,6-diphenyl pyrylium perchlorate |
| 5 | 4-[4-bis(2-chloroethyl)aminophenyl]-2-(4-methoxyphenyl)-6-phenylthiapyrylium perchlorate |
| 6 | 4-(4-dimethylaminophenyl)-2,6-diphenylthiapyrylium sulfate |
| 7 | 4-(4-dimethylaminophenyl)2,6-diphenylthiapyrylium p-toluenesulfonate |
| 8 | 4-(4-dimethylaminophenyl)-2,6-diphenylpyrylium p-toluenesulfonate |
| 9 | 2-(2,4-dimethoxyphenyl)-4-(4-dimethylaminophenyl)benzo(b)pyrylium perchlorate |
| 10 | 2,6-bis(4-ethylphenyl)-4-(4-dimethylaminophenyl)thiapyrylium perchlorate |
| 11 | 4-(4-dimethylaminophenyl)-2-(4-methoxyphenyl)-6-phenylthiapyrylium perchlorate |
| 12 | 4-(4-dimethylaminophenyl)-2-(4-ethoxyphenyl)-6-phenylthiapyrylium perchlorate |
| 13 | 4-(4-dimethylaminophenyl)-2-(4-methoxyphenyl)-6-(4-methylphenyl)pyrylium perchlorate |
| 14 | 4-(4-diphenylaminophenyl)-2,6-diphenylthiapyrylium perchlorate |
| 15 | 2,4,6-triphenylpyrylium perchlorate |
| 16 | 4-(4-methoxyphenyl)-2,6-diphenylpyrylium perchlorate |

TABLE 1-continued

| Compound Number | Name of Compound |
|---|---|
| 17 | 4-(2,4-dichlorophenyl)-2,6-diphenylpyrylium perchlorate |
| 18 | 4-(3,4-dichlorophenyl)-2,6-diphenylpyrylium perchlorate |
| 19 | 2,6-bis(4-methoxyphenyl)-4-phenylpyrylium perchlorate |
| 20 | 6-(4-methoxyphenyl)-2,4-diphenylpyrylium perchlorate |
| 21 | 2-(3,4-dichlorophenyl)-4-(4-methoxyphenyl)-6-phenylpyrylium perchlorate |
| 22 | 4-(4-amyloxyphenyl)2,6-bis(4-ethylphenyl) pyrylium perchlorate |
| 23 | 4-(4-amyloxyphenyl)-2,6-bis(4-methoxyphenyl) pyrylium perchlorate |
| 24 | 2,4,6-triphenylpyrylium fluoroborate |
| 25 | 2,6-bis(4-ethylphenyl)-4-(4-methoxyphenyl) pyrylium perchlorate |
| 26 | 2,6-bis(4-ethylphenyl)-4-(4-methoxyphenyl) pyrylium fluoroborate |
| 27 | 6-(3,4-diethoxystyryl)-2,4-diphenylpyrylium perchlorate |
| 28 | 6-(3,4-diethoxy-β-amylstyryl)-2,4-diphenylpyrylium fluoroborate |
| 29 | 6-(4-dimethylamino-β-ethylstyryl)-2,4-diphenylpyrylium fluoroborate |
| 30 | 6-(1-n-amyl-4-p-dimethylaminophenyl-1,3-butadienyl)-2,4-diphenylpyrylium fluoroborate |
| 31 | 6-(4-dimethylaminostyryl)-2,4-diphenylpyrylium fluoroborate |
| 32 | 6-[α-ethyl,β,β-bis(dimethylaminophenyl) vinylene]-2,4-diphenylpyrylium fluoroborate |
| 33 | 6-(1-butyl-4-p-dimethylaminophenyl-1,3-butadienyl)-2,4-diphenylpyrylium fluoroborate |
| 34 | 6-(4-dimethylaminostyryl)-2,4-diphenylpyrylium perchlorate |
| 35 | 6-[β,β-bis(4-dimethylaminophenyl vinylene]-2,4-diphenylpyrylium perchlorate |
| 36 | 2,6-bis(4-dimethylaminostyryl)-4-phenylpyrylium perchlorate |
| 37 | 6-(β-methyl-4-dimethylaminostyryl)-2,4-diphenylpyrylium fluoroborate |
| 38 | 6-[1-ethyl-4-(4-dimethylaminophenyl)-1,3-butadienyl]-2,4-diphenylpyrylium fluoroborate |
| 39 | 6-[β,β-bis(4-dimethylaminophenyl vinylene]-2,4-diphenylpyrylium fluoroborate |
| 40 | 6-[1-methyl-4-(4-dimethylaminophenyl)-1,3-butadienyl]-2,4-diphenylpyrylium fluoroborate |
| 41 | 4-(4-dimethylaminophenyl)2,6-diphenylpyrylium perchlorate |
| 42 | 2,6-bis(4-ethylphenyl)-4-phenylpyrylium perchlorate |
| 43 | 2,6-bis(4-ethylphenyl)-4-methoxyphenylthiapyrylium fluoroborate |
| 44 | 2,4,6-triphenylthiapyrylium perchlorate |
| 45 | 4-(4-methoxyphenyl)-2,6-diphenylthiapyrylium perchlorate |
| 46 | 6-(4-methoxyphenyl)-2,4-diphenylthiapyrylium perchlorate |
| 47 | 2,6-bis(4-methoxyphenyl)-4-phenylthiapyrylium perchlorate |
| 48 | 4-(2,4-dichlorophenyl)-2,6-diphenylthiapyrylium perchlorate |
| 49 | 2,4,6-tri(4-methoxyphenyl)thiapyrylium perchlorate |
| 50 | 2,6-bis(4-ethylphenyl)-4-phenylthiapyrylium perchlorate |
| 51 | 4-(4-amyloxyphenyl)2,6-bis(4-ethylphenyl thiapyrylium perchlorate |
| 52 | 6-(4-dimethylaminostyryl)-2,4-diphenylthiapyrylium perchlorate |
| 53 | 2,4,6-triphenylthiapyrylium fluoroborate |
| 54 | 2,4,6-triphenylthiapyrylium sulfate |
| 55 | 4-(4-methoxyphenyl)-2,6-diphenylthiapyrylium fluoroborate |
| 56 | 2,4,6-triphenylthiapyrylium chloride |
| 57 | 2-(4-amyloxyphenyl)-4,6-diphenylthiapyrylium fluoroborate |
| 58 | 4-(4-amyloxyphenyl)-2,6-bis(4-methoxyphenyl) thiapyrylium perchlorate |
| 59 | 2,6-bis(4-ethylphenyl)-4-(4-methoxyphenyl) |

TABLE 1-continued

| Compound Number | Name of Compound |
|---|---|
| | thiapyrylium perchlorate |
| 60 | 4-anisyl-2,6-bis(4-n-amyloxyphenyl)thiapyrylium chloride |
| 61 | 2-[β,β-bis(4-dimethylaminophenyl)vinylene]-4,6-diphenylthiapyrylium perchlorate |
| 62 | 6-(β-ethyl-4-dimethylaminostyryl)-2,4-diphenylthiapyrylium perchlorate |
| 63 | 2-(3,4-diethoxystyryl)-4,6-diphenylthiapyrylium perchlorate |
| 64 | 2,4,6-trianisylthiapyrylium perchlorate |
| 65 | 6-ethyl-2,4-diphenylpyrylium fluoroborate |
| 66 | 2,6-bis(4-ethylphenyl)-4-(4-methoxyphenyl)-thiapyrylium chloride |
| 67 | 6-[β,β-bis(4-dimethylaminophenyl)vinylene]-2,4-di(4-ethylphenyl)pyrylium perchlorate |
| 68 | 2,6-bis(4-amyloxyphenyl)-4-(4-methoxyphenyl) thiapyrylium perchlorate |
| 69 | 6-(3,4-diethoxy-β-ethylstyryl)-2,4-diphenyl-pyrylium fluoroborate |
| 70 | 6-(4-methoxy-β-ethylstyryl)-2,4-diphenyl-pyrylium fluoroborate |
| 71 | 2-(4-ethylphenyl)-4,6-diphenylthiapyrylium perchlorate |
| 72 | 2,6-diphenyl-4-(4-methoxyphenyl)thiapyrylium perchlorate |
| 73 | 2,6-diphenyl-4-(4-methoxyphenyl)thiapyrylium fluoroborate |
| 74 | 2,6-bis(4-ethylphenyl)-4-(4-n-amyloxyphenyl) thiapyrylium perchlorate |
| 75 | 2,6-bis(4-methoxyphenyl)-4-(4-n-amyloxyphenyl)-thiapyrylium perchlorate |
| 76 | 2,4,6-tris(4-methoxyphenyl)thiapyrylium fluoroborate |
| 77 | 2,4-diphenyl-6-(3,4-diethoxystyryl)pyrylium perchlorate |
| 78 | 4-(4-dimethylaminophenyl)-2-phenylbenzo(b) selenapyrylium perchlorate |
| 79 | 2-(2,4-dimethoxyphenyl)-4-(4-dimethylamino-phenyl)benzo(b)selenapyrylium perchlorate |
| 80 | 4-(4-dimethylaminophenyl)-2,6-diphenylselena pyrylium perchlorate |
| 81 | 4-(4-dimethylaminophenyl)-2-(4-ethoxyphenyl)-6-phenylselenapyrylium perchlorate |
| 82 | 4-[4-bis(2-chloroethyl) aminophenyl]-2,6-diphenylselenapyrylium perchlorate |
| 83 | 4-(4-dimethylaminophenyl)-2,6-bis(4-ethyl-phenyl)selenapyrylium perchlorate |
| 84 | 4-(4-dimethylamino-2-methylphenyl)-2,6-diphenylselenapyrylium perchlorate |
| 85 | 3-(4-dimethylaminophenyl)naphtho(2,1-b) selenapyrylium perchlorate |
| 86 | 4-(4-dimethylaminostyryl)-2-(4-methoxyphenyl)-benzo(b)selenapyrylium perchlorate |
| 87 | 2,6-di(4-diethylaminophenyl)-4-phenylselena-pyrylium perchlorate |
| 88 | 4-(4-dimethylaminophenyl)-2-(4-ethoxyphenyl)-6-phenylthiapyrylium fluoroborate |
| 89 | 4-benzylamino-2-phenylbenzo(b)pyrylium perchlorate |
| 90 | 4-anilino-2-(4-methoxyphenyl)naphtho(1,2-b)-pyrylium perchlorate |
| 91 | 4-(N—butylamino)-2-phenylbenzo(b)thiapyrylium perchlorate |
| 92 | 4-(N—butylamino)-2-(p-methoxyphenyl)benzo(b)-pyrylium perchlorate |
| 93 | 4-(4-dimethylaminophenyl)-2-(4-ethoxyphenyl)-6-phenyl thiapyrylium fluoroborate |
| 94 | 4-(4-dimethylaminophenyl)-2,6-diphenylthia-pyrylium hexafluorophosphate |
| 95 | 4-[2,6-(diphenyl-4H—thiopyran-4-ylidene) methyl]-2,6-diphenyl thiapyrylium perchlorate |

Preferred pyrylium dyes used in forming aggregate dye complexes are pyrylium dye salts having the formula:

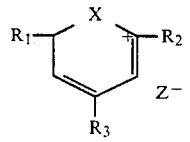

wherein:

$R_1$ and $R_2$ are each phenyl radicals, including substituted phenyl radicals having at least one substitute chosen from alkyl radicals of from 1 to 6 carbon atoms and alkoxy radicals having from 1 to 6 carbon atoms;

$R_3$ is an alkylamino-substituted phenyl radical having from 1 to 6 carbon atoms in the alkyl moiety including dialkylamino-substituted and halogenated alkylamino-substituted phenyl radicals;

X is an oxygen, tellurium, selenium or sulfur atom; and $Z^-$ is an anion, including such anions as perchlorate, fluoroborate, iodide, chloride, bromide, sulfate, periodate, p-toluenesulfonate, and hexafluorophosphate.

While the pyrylium dyes are preferred in preparing aggregate dye complexes, other photographic spectral sensitizing dyes that activate light exposed areas of photographic compositions can be utilized in the aggregate dye complex. Examples include the J-aggregated dyes disclosed in Gilman and Heseltine, U.S. Pat. No. 3,769,011 entitled Photoconductive Compositions and Elements Containing Methine Dye in J-Aggregate State, including J-aggregates of cyanine, merocyanine and styryl dyes such as anhydro-1-ethyl-1′-sulfobutyl-2,2′-cyanine hydroxide, 2-(5,5′-dicyano-2,4-pentenylidene)-3-ethylbenzothiazoline and 2-p-diethylamino-styryl-3-ethyl-6-(2-oxo-1-pyrrolidinyl)-benzothiazolium.

The aggregating dyes employed in according with the invention absorb radiation in the visible range of the spectrum as well as in the near ultraviolet and in the infrared regions of the spectrum. In general, the term dye has reference to substances which absorb radiation having a wavelength in the range of from about 300 to about $10^5$ μm.

Film-forming polymers suitable for the formation of aggregate dye complexes include polycarbonates and polythiocarbonates, polyvinyl ethers, polyesters, polyolefins, and phenolic resins. Mixtures of such polymers can also be utilized. Examples of polymers from these classes are set out in Table 2.

TABLE 2

| Number | Polymers |
|---|---|
| 1 | polystyrene |
| 2 | polyvinyltoluene |
| 3 | polyvinylanisole |
| 4 | polychlorostyrene |
| 5 | poly-α-methylstyrene |
| 6 | polyacenaphthalene |
| 7 | poly(vinyl isobutyl ether) |
| 8 | poly(vinyl cinnamate) |
| 9 | poly(vinyl benzoate) |
| 10 | poly(vinyl naphthoate) |
| 11 | polyvinyl carbazole |
| 12 | poly(vinylene carbonate) |
| 13 | polyvinyl pyridine |
| 14 | poly(vinyl acetal) |
| 15 | poly(vinyl butyral) |
| 16 | poly(ethyl methacrylate) |
| 17 | poly(butyl methacrylate) |
| 18 | poly(styrene-co-butadiene) |
| 19 | poly(styrene-co-methyl methacrylate) |
| 20 | poly(styrene-co-ethyl acrylate) |

TABLE 2-continued

| Number | Polymers |
|---|---|
| 21 | poly(styrene-co-acrylonitrile) |
| 22 | poly(vinyl chloride-co-vinyl acetate) |
| 23 | poly(vinylidene chloride-co-vinyl acetate) |
| 24 | poly(4,4'-isopropylidenediphenyl-co-4,4'-isopropylidenedicyclohexyl carbonate) |
| 25 | poly[4,4'-isopropylidenebis(2,6-dibromophenyl)carbonate] |
| 26 | poly[4,4'-isopropylidenebis(2,6-dichlorophenyl)carbonate] |
| 27 | poly[4,4'-isopropylidenebis(2,6-dimethyl phenyl)carbonate] |
| 28 | poly(4,4'-isopropylidenediphenyl-co-1,4-cyclohexyldimethyl carbonate) |
| 29 | poly(4,4'-isopropylidenediphenyl terephthalate-co-isophthalate) |
| 30 | poly(3,3'-ethylenedioxyphenyl thiocarbonate) |
| 31 | poly(4,4'-isopropylidenediphenyl carbonate-co-terephthalate) |
| 32 | poly(4,4'-isopropylidenediphenyl carbonate) |
| 33 | poly(4,4'-isopropylidenediphenyl thiocarbonate) |
| 34 | poly(2,2-butanebis-4-phenyl carbonate) |
| 35 | poly(4,4'-isopropylidenediphenyl carbonate-block-ethylene oxide) |
| 36 | poly(4,4'-isopropylidenediphenyl carbonate-block-tetramethyleneoxide) |
| 37 | poly[4,4'-isopropylidenebis(2-methylphenyl) carbonate] |
| 38 | poly(4,4'-isopropylidenediphenyl-co-1,4-phenylene carbonate) |
| 39 | poly(4,4'-isopropylidenediphenyl-co-1,3-phenylene carbonate) |
| 40 | poly(4,4'-isopropylidenediphenyl-co-4,4'-diphenyl carbonate) |
| 41 | poly(4,4'-isopropylidenediphenyl-co-4,4'-oxydiphenyl carbonate) |
| 42 | poly(4,4'-isopropylidenediphenyl-co-4,4'-carbonyldiphenyl carbonate) |
| 43 | poly(4,4'-isopropylidenediphenyl-co-4,4-ethylenediphenyl carbonate) |
| 44 | poly[4,4'-methylene bis(2-methylphenyl) carbonate] |
| 45 | poly[1,1-(p-bromophenylethane)bis(4-phenyl)-carbonate] |
| 46 | poly[4,4'-isopropylidenediphenyl-co-sulfonyl bis(4-phenyl)carbonate] |
| 47 | poly[1,1-cyclohexane bis(4-phenyl)carbonate] |
| 48 | poly(4,4'-isopropylidenediphenoxydimethylsilane) |
| 49 | poly[4,4'-isopropylidene bis(2-chlorophenyl)carbonate] |
| 50 | poly[α,α,α',α'-tetramethyl-p-xylene bis-(4-phenyl carbonate)] |
| 51 | poly(hexafluoroisopropylidenedi-4-phenyl carbonate) |
| 52 | poly(dichlorotetrafluoroisopropylidenedi-4-phenyl carbonate) |
| 53 | poly(4,4'-isopropylidenediphenyl 4,4'-isopropylidene-dibenzoate) |
| 54 | poly(4,4'-isopropylidenedibenzyl 4,4'-isopropylidene-dibenzoate) |
| 55 | poly(4,4'-isopropylidenedi-1-naphthyl carbonate) |
| 56 | poly[4,4'-isopropylidene bis(phenoxy-4-phenyl sulfonate)] |
| 57 | acetophenone formaldehyde resin |
| 58 | poly[4,4'-isopropylidene bis(phenoxyethyl)-co-ethylene terephthalate] |
| 59 | phenol-formaldehyde resin |
| 60 | polyvinyl acetophenone |
| 61 | chlorinated polypropylene |
| 62 | chlorinated polyethylene |
| 63 | poly(2,6-dimethylphenylene oxide) |
| 64 | poly(neopentyl-2,6-naphthalenedicarboxylate) |
| 65 | poly(ethylene terephthalate-co-isophthalate) |
| 66 | poly(1,4-phenylene-co-1,3-phenylene succinate) |
| 67 | poly(4,4'-isopropylidenediphenyl phenylphosphonate) |

TABLE 2-continued

| Number | Polymers |
|---|---|
| 68 | poly(m-phenylcarboxylate) |
| 69 | poly(1,4-cyclohexanedimethyl terephthalate-co-isophthalate) |
| 70 | poly(tetramethylene succinate) |
| 71 | poly(phenolphthalein carbonate) |
| 72 | poly(4-chloro-1,3-phenylene carbonate) |
| 73 | poly(2-methyl-1,3-phenylene carbonate) |
| 74 | poly(1,1-bi-2-naphthyl thiocarbonate) |
| 75 | poly(diphenylmethane bis-4-phenyl carbonate) |
| 76 | poly[2,2-(3-methylbutane)bis-4-phenyl carbonate] |
| 77 | poly[2,2-(3,3-dimethylbutane)bis-4-phenyl carbonate] |
| 78 | poly[1,1-[1-(1-naphthylethylidene)]bis-4-phenyl carbonate] |
| 79 | poly[2,2-(4-methylpentane)bis-4-phenyl carbonate] |
| 80 | poly[4,4'-(2-norbornylidene)diphenyl carbonate] |
| 81 | poly[4,4'-(hexahydro-4,7-methanoindan-5-lidene)diphenyl carbonate] |

Especially useful polymers for forming the aggregate dye complex composition are numbers 28, 30–47, 49, 51, 53, 54, and 76–81 in Table 2 above.

Included among the preferred polymers used for preparing the aggregate dye complex compositions are those linear polymers, including copolymers having an alkylidene diarylene group in the recurring unit; preferably as follows:

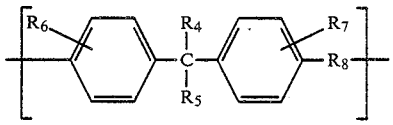

wherein:

$R_4$ and $R_5$, when taken separately, can each be a hydrogen atom, an alkyl radical such as methyl, ethyl, propyl, isopropyl, butyl, tertiary butyl, pentyl, hexyl, heptyl, octyl, nonyl, and decyl including substituted alkyl radicals such as trifluoromethyl and an aryl radical such as phenyl and naphthyl including substituted aryl radicals having such substituents as a halogen, alkyl radicals of from 1 to 5 carbon atoms; and $R_4$ and $R_5$, when taken together, can represent the carbon atoms necessary to form a cyclic hydrocarbon radical including cycloalkanes such as cyclohexyl and polycycloalkanes such as norbornyl, the total number of carbon atoms in $R_4$ and $R_5$ being up to 19;

$R_6$ and $R_7$ can each be hydrogen, an alkyl radical of from 1 to 5 carbon atoms or a halogen such as chloro, bromo, iodo and $R_8$ is a divalent radical selected from the following:

$$-O-\overset{O}{\overset{\|}{C}}-O-,\ -O-\overset{S}{\overset{\|}{C}}-O-,\ -\overset{O}{\overset{\|}{C}}-O-,\ -\overset{O}{\overset{\|}{C}}-O-CH_2-,$$

$$-\overset{O}{\overset{\|}{C}}-O-\overset{CH_3}{\overset{|}{CH}}-,\ -CH_2-O-\overset{O}{\overset{\|}{C}}-O- \text{ and}$$

-continued

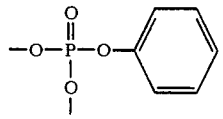

Among the hydrophobic carbonate polymers particularly useful are polymers comprised of the following recurring unit:

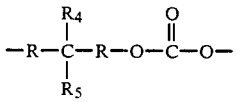

wherein: each R is a phenylene radical including halo substituted phenylene radicals and alkyl substituted phenylene radicals; and $R_4$ and $R_5$ are described above. Such compositions are disclosed, for example, in U.S. Pat. Nos. 3,028,365 and 3,317,466. Preferably, polycarbonates containing an alkylidene diarylene moiety in the recurring unit such as those prepared with Bisphenol A and including polymeric products of ester exchange between diphenylcarbonate and 2,2-bis(4-hydroxyphenyl)-propane are used in the practice of this invention. Such compositions are disclosed in the following U.S. Pat. Nos. 2,999,750; 3,038,874; 3,038,879; 3,038,880; 3,106,544; 3,106,545; 3,106,546; and published Australian Patent Specification No. 19575/56. A wide range of film-forming polycarbonate resins are useful, particularly satisfactory results are obtained when using commercial polymers which are characterized by an inherent viscosity of about 0.5 to 0.6. In addition, a high molecular weight polymer such as a high molecular weight Bisphenol A polycarbonate can be very useful. Preferably, such high molecular weight materials have an inherent viscosity of greater than about 1 as measured in 1,2-dichloroethane at a concentration of 0.25 g./100 ml. and a temperature of about 25° C. The use of high molecular weight polycarbonate, for example, facilitates the formation of aggregate compositions having a higher dye concentration.

Liquids useful for treating polymer-dye coatings to form the aggregate dye complexes can include a number of organic solvents such as aromatic hydrocarbons, for example, benzene and toluene, ketones such as acetone and ethylmethyl ketone, halogenated hydrocarbons such as methylene chloride and alcohols like methyl, ethyl, and benzyl alcohol, as well as mixtures of such solvents.

The information recording element used in the process of the invention can be formed by coating a layer of the aggregate dye complex on a support. A suitable procedure is to dissolve the pyrylium dye in a solvent, then add polymer and, if the element is to be used as a photoconductive element, a photoconductor compound. The techniques for forming aggregate dye complexes in this manner and then coating the composition on a support are well known and have been disclosed in the various patents cited herein.

The recording element is formed by coating the aggregate dye complex in a solvent, with or without added photoconductors onto a film or other kind of support. The latter can include paper; foils or plates of metals such as aluminum, nickel and copper; and polymeric films such as poly(ethylene terephthalate), polyolefins or cellulose acetate. For photoconductive elements, the film supports will have a conductive layer such as a vapor-deposited aluminum or nickel layer.

Recording of information on films or other elements containing a layer of the above-described aggregate dye complexes can be effected by selectively deaggregating the desired areas causing the aggregate dye complex to revert to a homogeneous state in the area exposed. This results in a shift in the wavelength of the radiation absorption maximum, producing a visible color change in the material.

The preferred method of treating the aggregate dye complex is by exposing it to actinic radiation such as laser light. Although the mechanism of deaggregation is not fully understood, it is hypothesized that the light absorbed by the material may raise the temperature in the exposed area. When sufficient energy is absorbed to cause the aggregate dye complex to revert to a homogeneous state, a color shift occurs and the visible image is recorded.

After the information is recorded on the aggregate dye complex layer, it can be read simply by visually reading the areas of color change. Alternatively, the deaggregated areas can be detected by scanning the aggregate dye complex with light and measuring the variations in intensity of reflected or transmitted light as the light strikes aggregated and deaggregated areas. Another way of reading the recorded information is by detecting the difference in photoconductivity between the aggregated and deaggregated areas.

Any laser beam which emits radiation in the visible or infrared region of the spectrum can be used, provided it can deliver sufficient energy. Thus, crystalline or amorphous solid, pulsed or continuous wave, lasers such as ruby or neodymium-doped YAG (yttrium-aluminum-garnet), or dye lasers can be used. Gas lasers such as helium-neon, argon ion, krypton-ion or carbon dioxide lasers are also useful. Solid state injection lasers can also be used.

To optimize efficiency, it is desirable to select an aggregate recording element which absorbs at the wavelength of the radiation of the particular laser being used. For example, a thiopyryllium dye complex could be suitable with a helium-neon laser which emits at about 633 nm or for an argon ion laser which emits at about 488 nm. Telluropyryllium dye aggregates could be appropriate for diode lasers which emit in the infrared range.

As mentioned hereinbefore the information written on the aggregate dye complex layer is readily erased in accordance with the invention by softening the composition sufficiently so as to allow the deaggregated areas to reaggregate. This can be accomplished by exposing the element to an appropriate solvent which causes the homogeneous areas of the material to revert back to the heterogeneous state, i.e. to reaggregate, and the color shift is reversed. One method is to fume the material with vapors of the solvent; alternatively, liquid solvent may be directly applied to the material. Organic solvents useful for this process can be selected from a wide variety of materials. Useful liquids include hydrocarbon solvents and substituted hydrocarbon solvents, with preferred solvents being halogenated hydrocarbons. The requisite properties of the solvent are that it be capable of dissolving the pyrylium dye and capable of dissolving or at least greatly swelling or solubilizing the polymeric ingredient of the composition. In addition, it is helpful if the solvent is volatile, preferably having a boiling point of less than about 200° C. Particularly useful solvents include halogenated lower alkanes having from 1 to about 3 carbon atoms, such as dichloromethane, dichloroethane, dichloro-propane, trichloromethane, trichloroethane, tribromomethane, trichloromonofluoromethane, trichlorotrifluoroethane; aromatic hydrocarbons such as benzene, toluene as well as halogenated benzene compounds such as chlorobenzene, bromobenzene, dichlorobenzene; ketones such as dialkyl ketones having 1 to about 3 carbon atoms in the alkyl moiety, such as dimethylketone, methylethylketone; and ethers such as tetrahydrofuran. Mixtures of these and other solvents can also be used.

Erasure can also be accomplished by heating the composition. If the heat supplied is sufficient to soften the composition, but not so great as to cause deaggregation, the dye and polymer or the dye will reaggregate and the color change will be reversed. This heat may be supplied by conduction, convection and/or radiation, including exposure to actinic radiation such as laser light.

The following examples illustrate the present invention.

EXAMPLE 1

A film coated with a layer of an aggregate dye complex of the type of the first coating disclosed in Example 5 of U.S. Pat. No. 3,615,414 was exposed with 580 nm light from a Nd:YAG pumped tunable dye laser with about a 10 nanosecond pulse duration which operates at 10 pulse/second. The energy of the laser pulse was approximately 1 mj and the total exposure time was of the order of 1 second. The exposure was in the pattern of the letter "T" and the 580 nm light, which was absorbed entirely by the aggregate dye complex, caused the aggregate dye complex to revert to a homogeneous state in the exposed areas producing a hyposochromic shift of the dye of about 100 nm causing the color of the material to shift from light blue to dark blue.

The imaged "T" in the upper half of the aggregate dye complex layer was then exposed to fumes of dichloromethane, erasing the image, i.e., causing the exposed areas to revert back to the heterogeneous state and the original color.

The following example illustrates the reuse characteristics of the aggregate dye complex:

EXAMPLE 2

A letter T image was produced by laser exposure in Example 1. The image was then completely erased by exposure to dichloromethane vapors as described in Example 1. The erased area was then re-imaged and a second image (letter T) was formed in the re-exposed areas by a laser beam.

The next example illustrates recording of a pattern in accordance with the invention but using a different type of laser.

EXAMPLE 3

A dye-polymer co-crystalline aggregate photoconductive film as in the previous examples was exposed in the pattern of the letters "EK" to a $CO_2$ laser instead of the tunable laser of the previous examples. The wavelength of the laser radiation was about 10 μm. Again the dye-polymer was deaggregated where exposed, thus forming an erasable pattern of the letters EK in aggregate. With this laser, however, its infrared radiation was absorbed by the entire film and not just by the co-crystalline aggregate as in Examples 1 and 2. Therefore, all of the components of the film including the polymeric support were heat-embossed with the exposure pattern. Although the aggregate can be reaggregated to obtain the bathochromic shift in color, the pattern is not completely erased since it is permanently embossed in the support. This example illustrates that when complete erasure of the recorded image is desired, one should employ actinic radiation in the recording step of the method which does not permanently deform or change the components of the recording element. Preferably, when a laser is employed for recording, its radiation is of a wavelength that is not absorbed by the support on which the aggregate dye complex is coated.

The method of this invention can also be employed with an aggregate dye complex photoconductive element for use in electrophotographic imaging processes. Such processes involve the formation of an electrostatic charge pattern or image on a photoconductive element. When the photoconductive element is selectively deaggregated in accordance with the present invention, the photoconductive sensitivity is reduced by 10 to 100 times in the deaggregated areas, as compared to the aggregated areas. This property is extremely useful. For example, an image pattern can be recorded on the photoconductive element by selective deaggregation. The element may then be used as a printing plate or duplicating master. In this use, the selectively deaggregated element is electrostatically uniformly charged, for example, by corona discharge. The element is then exposed to light of an energy level which is sufficiently low that it does not cause deaggregation of the aggregated areas of the element. Since the resultant differential image pattern exhibits a differential photosensitivity, the light exposure removes charge selectively from the more photoconductive aggregated areas. A charge pattern corresponding to the image pattern of the selectively deaggregated areas remains on the element. This pattern is developed with dry or liquid toner in known manner and transferred to a receiving sheet. The process can be repeated as desired, thus using the element as a master or printing plate. The differential photosensitivity patterns can also exhibit a differential dark conductivity, allowing the use of the element as a xeroprinting master. The visibility of the recorded pattern on the photoconductive element is advantageous, for it can be erased and amended as desired before printing copies with the element.

As another example, a halftone dot or screen pattern can be recorded on the element by a laser beam or other deaggregating means. This will improve solid area or continuous tone reproduction when the element is used as a photoconductor in electrophotographic processes. The erasability of the dot or screen pattern, in accordance with the invention, provides an important advantage.

The invention has been described in detail with particular reference to certain preferred embodiments thereof, but it will be understood that variations and modifications can be effected within the spirit and scope of the invention.

I claim:

1. A process for recording information visibly, which comprises exposing a layer of aggregate dye complex to actinic radiation that deaggregates said complex and produces a color change in exposed areas, said aggregate dye complex comprising a co-crystalline complex of polymer and dye or of dye and dye.

2. A process according to claim 1 wherein:
said actinic radiation is laser radiation.

3. A process according to claim 1, further comprising:
erasing recorded information by softening at least selected deaggregated areas sufficiently to allow reaggregation.

4. A process according to claim 3 wherein the aggregate dye complex is a co-crystalline complex of a polymer having an alkylidene diarylene group in the recurring unit and of a pyrylium, thiapyrylium, telluropyrylium or selenapyrylium dye salt.

5. A process according to claim 3, wherein:
said erasing step is accomplished by treating the selected deaggregated areas with solvent.

6. A process according to claim 5, wherein:
said treatment comprises fuming the selected deaggregated areas with the vapors of said solvent.

7. A process according to claim 3 wherein:
said erasing step is accomplished by heating the selected deaggregate areas sufficiently to allow reaggregation, but not to the extent to cause further deaggregation.

8. A process according to claim 7, wherein:
said heating is accomplished by exposure to laser radiation.

9. A process for selectively reducing the photoconductive sensitivity of an electrophotographic photoconductive element having a layer containing an aggregate dye complex comprising a co-crystalline complex of polymer and dye or of dye and dye, which process comprises exposing said layer in selected areas to actinic radiation that deaggregates said aggregate dye complex in said selected areas.

10. A process according to claim 9, wherein said photoconductive element is thereafter used as an electrophotographic duplicating master by electrostatically uniformly charging, uniformly exposing to light, developing the resultant charge pattern with toner and transferring the developed pattern to a receiving sheet.

11. A process according to claim 9, wherein said selected deaggregated areas form a halftone screen pattern.

* * * * *